US009873065B2

(12) United States Patent
Coon

(10) Patent No.: US 9,873,065 B2
(45) Date of Patent: Jan. 23, 2018

(54) HYPERBOLOID DEVICE WITH SLIDING ELEMENTS

(71) Applicant: 106 Labs, L.L.C., Plymouth, MI (US)

(72) Inventor: Zachary Aaron Coon, Plymouth, MI (US)

(73) Assignee: 106 Labs, L.L.C., Plymouth, MI (US)

( * ) Notice: Subject to any disclaimer, the term of this patent is extended or adjusted under 35 U.S.C. 154(b) by 311 days.

(21) Appl. No.: 14/747,769

(22) Filed: Jun. 23, 2015

(65) Prior Publication Data

US 2016/0016094 A1 Jan. 21, 2016

Related U.S. Application Data

(60) Provisional application No. 62/024,926, filed on Jul. 15, 2014.

(51) Int. Cl.
*A63H 33/22* (2006.01)
*A63H 17/26* (2006.01)

(52) U.S. Cl.
CPC ..... *A63H 33/22* (2013.01); *A63H 17/262* (2013.01)

(58) Field of Classification Search
USPC ..... 446/175, 219, 249, 250, 251, 253, 254, 446/255, 259, 266
See application file for complete search history.

(56) References Cited

U.S. PATENT DOCUMENTS

| | | | | |
|---|---|---|---|---|
| 2,558,423 | A | 6/1951 | Dobrosky | |
| 3,516,195 | A * | 6/1970 | Batley | A63H 1/32 446/254 |
| 4,467,404 | A | 8/1984 | Gordon | |
| 4,721,030 | A | 1/1988 | Paynter | |
| 4,906,050 | A | 3/1990 | Soder et al. | |
| 4,986,790 | A * | 1/1991 | Boury | A63H 1/32 446/219 |
| D320,827 | S * | 10/1991 | Centafanti | D21/692 |
| 8,597,068 | B1 * | 12/2013 | Stathis | A63H 1/32 446/253 |
| 2005/0136791 | A1 * | 6/2005 | Bellon | A63J 19/006 446/327 |
| 2007/0101794 | A1 | 5/2007 | Lacherade et al. | |

OTHER PUBLICATIONS

Korean Patent Office, International Search Report and Written Opinion of International Searching Authority for PCT/US2015/037227 dated Oct. 27, 2015 (7 pages).

* cited by examiner

*Primary Examiner* — Nini Legesse
(74) *Attorney, Agent, or Firm* — Joseph A. Fuchs; Greensfelder, Hemker & Gale, P.C.

(57) ABSTRACT

A device is disclosed having a central axis and opposed spaced apart parallel plates with slots and lacing holes therein for receiving linear elements such as string or lines.

41 Claims, 5 Drawing Sheets

HYPERBOLOID DEVICE WITH SLIDING ELEMENTS

RELATED U.S. APPLICATION DATA

This application claims priority to U.S. Provisional Patent Application Ser. No. 62/024,926 filed Jul. 15, 2014 which is incorporated in its entirety herein by reference and made a part hereof.

FIELD OF THE INVENTION

A toy, amusement, or art device having an interior or exterior member supporting two facing plates or rings in parallel spaced relationship with a plurality of strings or lines extending between the plates or rings with each string or line supporting one or more sliding elements that slide in reciprocating translational fashion between the plates or rings upon rotation of the toy about its axis.

BACKGROUND OF THE INVENTION

While there are a lot of craft projects on the market for children, there are few that are fun to build and fun to play with once made. Fewer are those that can be displayed as pieces of art. The present invention provides a system or kit for building a device that is fun to build and fun to play with and can be displayed as a piece of art. The device is suitable for use by children and adults and can be a stand-alone device or incorporated into other devices. Additionally, the device can be made and sold in a wide variety sizes from hand-held types to very large varieties such as for display in a park or the lobby of a building that are driven, for example, by a motive force supplied by an electric motor, internal combustion engine, wind energy, hydroelectric energy, or solar power just to name a few.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying Figures in which.

DETAILED DESCRIPTION

Figure 1A:
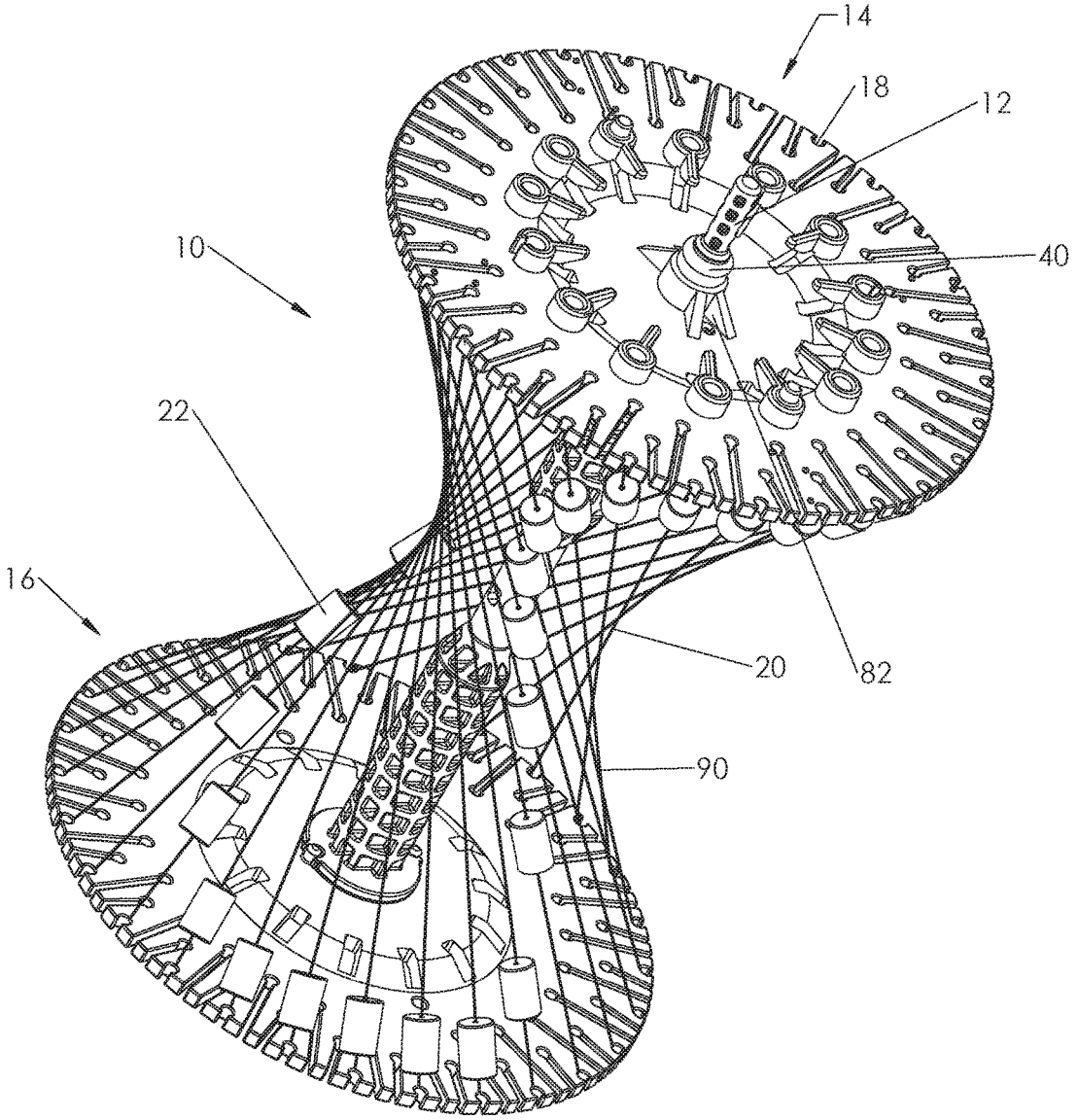
FIG. 1A is an isometric view of a single hyperboloid device made in accordance with the teachings of the present invention.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 9:
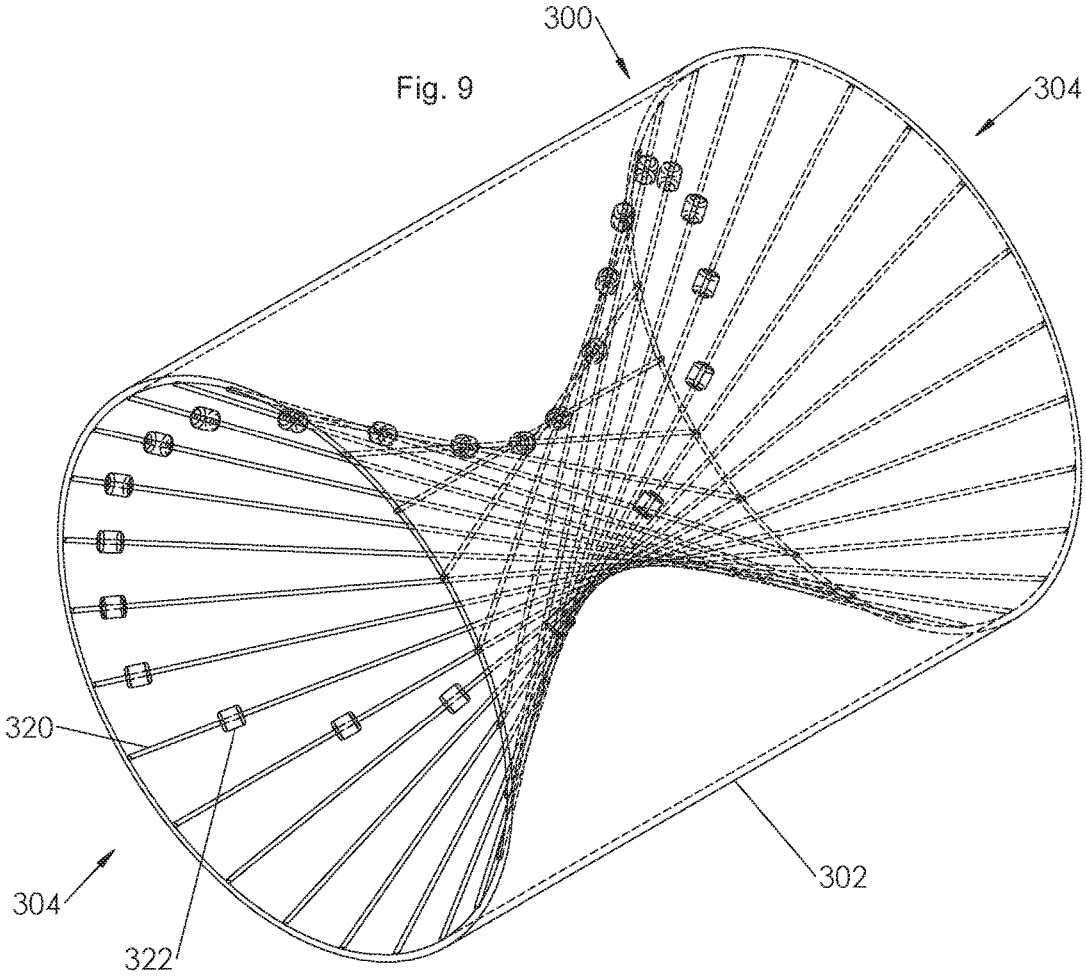
FIG. 9 is an isometric view of an alternate embodiment of the present invention.

The present invention provides a toy, amusement, or art device having an interior or exterior member supporting two facing plates or rings or surfaces in parallel spaced relationship with a plurality of strings or lines extending between the plates or surfaces with each string or line supporting one or more sliding elements that slide in reciprocating translational fashion between the plates or rings upon rotation of the toy about its axis. FIGS. 1-8 show an interior member, and axle, supporting two opposed plates and FIG. 9 shows an exterior member, a cylindrical wall, supporting two opposed rings.

FIGS. 1A,B show a device 10 having an elongate axle or hub 12 having opposed ends, a first plate 14 and a second plate 16 connected to the axle spaced from one another in parallel relationship. Each of the first plate and the second plate has a plurality of contact points 18 for receiving and guiding a plurality of linear elements 20. A plurality of sliding elements 22 can be provided, one of each being mounted on a linear element and capable of sliding on the linear element in reciprocating translational fashion between the first and second plates in response to rotation of the device with the axle. FIG. 1A shows a single hyperboloid device with one plurality of contact points, linear elements and sliding elements. FIG. 2A shows a double hyperboloid device 10' with two pluralities of contact points, linear elements 20,20' and sliding elements 22,22' concentrically mounted about the axle. The description below will apply to a hyperboloid of any number.

Figure 1B:
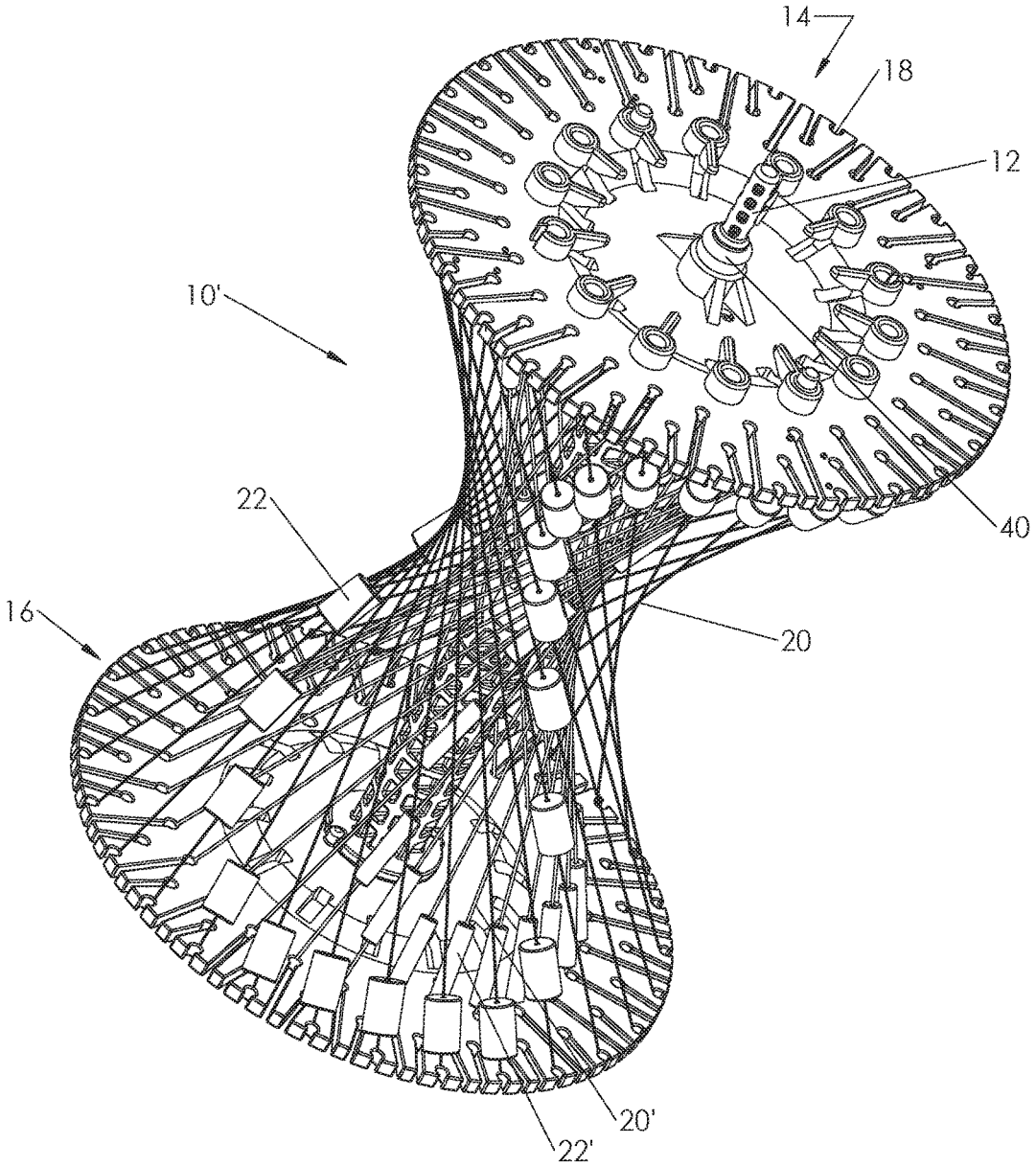
FIG. 1B is an isometric view of a double hyperboloid device made in accordance with the teachings of the present invention.

FIGS. 1A,B show a device 10 having an elongate axle or hub 12 having opposed ends, a first plate 14 and a second plate 16 connected to the axle spaced from one another in parallel relationship. Each of the first plate and the second plate has a plurality of contact points 18 for receiving and guiding a plurality of linear elements 20. A plurality of sliding elements 22 can be provided, one of each being mounted on a linear element and capable of sliding on the linear element in reciprocating translational fashion between the first and second plates in response to rotation of the device with the axle. FIG. 1A shows a single hyperboloid device with one plurality of contact points, linear elements and sliding elements. FIG. 1B shows a double hyperboloid device 10' with two pluralities of contact points, linear elements 20,20' and sliding elements 22,22' concentrically mounted about the axle. The description below will apply to a hyperboloid of any number.

Figure 4:
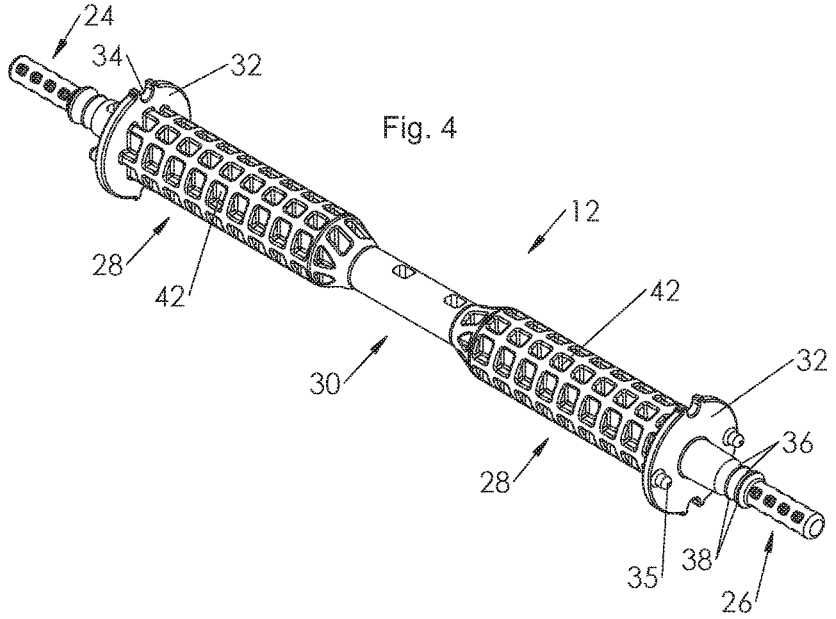
FIG. 4 is a perspective view of an axle of the present invention.
Figure 5:
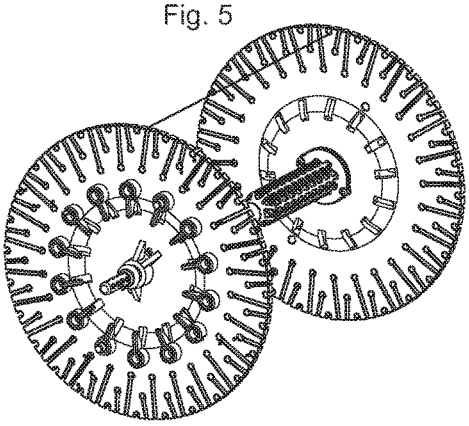
FIG. 5 is a perspective view of contact points on a first plate being in circumferential registration with contact points on a second plate.

In one preferred form of the invention as best shown in FIG. 4, the axle 12 will have opposed first and second ends 24,26, two intermediate sections 28 and a single middle section 30 disposed therebetween. One of each of two opposed generally circular flanges 32 separates the intermediate section from the opposed first and second ends. Each of the circular flanges has two detents 34 on the outer peripheral surface and equally spaced about the circumference of the circular flange. The detents 34 are dimensioned to receive posts 75 extending from an interior surface of the plates. A pair of posts 35 extend axially away from an outer surface of the circular flanges 32 and are dimensioned to fit, one of each, into a corresponding hole 84 on the plates 14,16. The posts 35 are positioned proximate the peripheral surface of the flange and one of each are positioned between the detents. The posts and holes ensure the desired circumferential alignment between the plates and to lock the plates to the axle for co-rotation about the axle.

The central section 30 of the axle 12 has a reduced diameter when compared to the intermediate sections 28 and has a generally smooth outer surface. The axle 12 can be a unitary structure or can be assembled from separate elements and, in one form of the invention, is spring loaded so as to bias the components axially outwardly to maintain a secure engagement with the plates.

Figure 2:
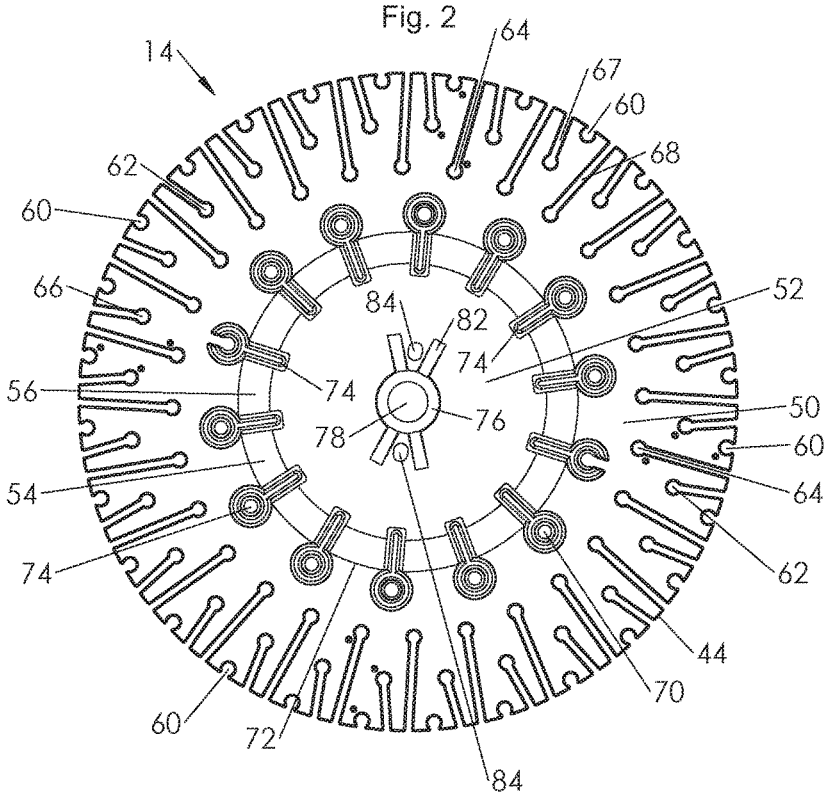
FIG. 2 is an end view of a plate of the device of FIG. 1A.
Figure 3:
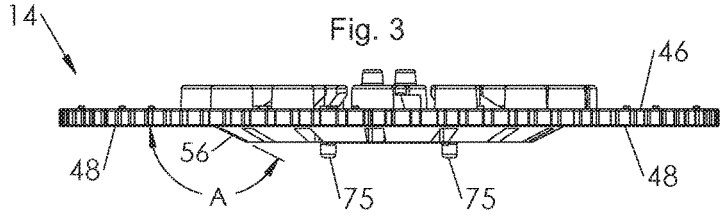
FIG. 3 is a side-elevation view of the plate of FIG. 2.

In the embodiments shown in FIGS. 1-3, the first and second plates 14,16 are identical in structure, although it is contemplated the first and second plates 14,16 could differ in some respects such as the overall shape of the plates and the arrangement of the contact points. Thus, sometimes the first and second plates will be referred to collectively as "the plates" without specifying which plate as the description applies equally to both plates.

In one preferred form of the invention, the plates are generally circular in shape having an outer peripheral edge 44, outer and inner planar surfaces 46,48, an outer ring 50, an inner ring 52 and an intermediate ring 54 connecting the outer ring to the inner ring. The outer ring 50 and the inner ring 52 are axially offset from one another and are concentrically disposed about the axle 12. The intermediate ring 54 has an axially inwardly and radially inwardly sloping surface 56 from the outer ring to the inner ring that forms an angle A with the inner planar surface 48 of the plate. Thus, the outer ring of the plate and the inner ring of the plate are not coplanar, rather, they are positioned in parallel planes. The intermediate ring has rectangular-shaped holes corresponding with each guide 74 discussed below for injection molding purposes. Additionally, a pair of posts 75 extend axially away from the inner planar surface 46 of the inner ring 52 and are dimensioned to be received by the detents 34 of the axle 12.

While the plates are shown to be generally circular, it is contemplated the plates could have virtually any shape such as circular, oval, polygonal, amorphous, or in the form of letters of an alphabet, numbers, symbols, logos, trademarks, or combinations of the same. For example, one plate could be the first initial of a person's first name and the other plate could be the initial of the person's last name. Any one of these shapes can be provided with a ring or other shaped surface to support the contact points 18.

The outer ring 50 of the plates has several pluralities or groups of contact points radially spaced from one another along the outer edge or circumference of the plate. A first plurality of contact points 60 are positioned on the peripheral edge 44 of the plates, a second plurality of contact points 62 are positioned radially inwardly from the first set, and a third plurality of contact points 64 are positioned radially inwardly of the first and second plurality of contact points. Each of the plurality of contact points are circumferentially offset such that a radial line drawn from the center of the plate to the peripheral edge 44 will intersect only a single contact point of one of the first, second and third plurality of contact points. However, two or more plurality of contact points can be in circumferential registration without departing from the present invention.

While three groups of contact points are shown in FIGS. 1 and 2, it is contemplated that any number of groups can be provided, say for example, from 1 to 100, and more preferably 1 to 10 groups, by adjusting the dimensions of the component parts and the number and spacing of the contact points. Devices having a single plurality of contact points are sometimes referred to as a single hyperboloid (FIG. 1A) and those with two pluralities of contact points as a double hyperboloid (FIG. 1B) and so on.

In a preferred form of the invention, each of the plurality of contact points forms a generally circular pattern, and in a more preferred form of the invention, each of the plurality of contact points is concentrically disposed about the axle 12. It is contemplated, however, that each of the plurality of contact points can form a shape or pattern different from a circle such as one that is arcuate, semi-circular, oval, polygonal, irregular, and any combinations of the same, for example, and each plurality can have the same or different shape from the other plurality of contact points. Additionally, the first and second plurality contact points each have 28 contact points, it is contemplated that the number of contact points in the first plurality can differ from those of the second plurality. Also, the number of contact points in any of the plurality can be from 2 to n contact points with n being practically limited only by the size of the plates, but for hand-held devices n can be from 3 to about 100 and more preferably from 16-56. Also, in one preferred form of the invention, the number of contact points will be an even number as the linear elements will start and end on the same plate instead of on opposite plates in odd numbered embodiments.

In a further preferred form of the invention, each individual contact point is capable of guiding the linear element through a desired course, and in one preferred form of the invention, is a lacing hole 66 that extends through the thickness of the plate. The lacing hole 66 can have a variety of shapes and sizes, and can be arcuate, generally circular, semi-circular, oval or polygonal. Of course, in the alternative, the contact points can also be a structure other than a lacing hole such as grooves or projections in or on the plates that guide and hold the linear elements along a desired course.

In a further preferred form of the invention, the lacing holes 66 will have access or be in communication with the peripheral edge 44 of the plates. One of each of a first plurality of slots 67 connects one of each of the second plurality of contact points to the periphery. Similarly, one of each of a second plurality of slots 68 connects one of each of a third plurality of contact points to the periphery. Each of the first plurality of slots forms a first angle with a radial line drawn through the center of a contact point associated with the slot and each of the second plurality of slots 68 forms a second angle with a radial line drawn through the center a contact point associated with each slot.

It should be noted that in one preferred form of the invention, symmetry is a central aspect of the present invention. The lacing holes, slots, and plates are symmetrical. Specifically, the size and locations of the slots and lacing holes are symmetrical with one another and the outer perimeter edge and the plates are symmetrical with one another.

Each of the first and second plurality of slots are generally linear and each of the slots of the first plurality are of are generally constant dimension in terms of length and width, and the same is true of the dimensions of each of the second plurality of slots. The slots could be of a shape other than linear, such as arcuate, and having a varying width along its length. While the first and second plurality of slots do not intersect one another, it is contemplated that the slots could intersect.

In one preferred form of the invention, each of the plurality of contact points on the first plate 14 is in circumferential registration with each of a plurality of contact points on the second plate 16. That is, a line drawn parallel to the axle from one contact point on the first plate contacts a corresponding contact point on the second plate. (FIG. 5) However, it is additionally contemplated that the plurality of contact points on the first plate can be circumferentially offset from the plurality of contact points on the second plate such that if a line is drawn parallel to the axle from a contact point on the first plate it would intersect the second plate between two adjacent contact points. In this case the contact points are out of registration.

In another form of the present invention, the plurality of contact points on the first plate are in a mixed-registration configuration with those on the second plate such that several adjacent contact points on the first plate are in registration with corresponding contact points on the second plate while others are out of registration. Thus, it is contemplated that there may be several in-registration segments and/or several out-of-registration portions within a single plurality of contact points in a mixed-registration configuration. In embodiments of the device where there are more than one plurality of contact points, each of the plurality of contact points can be in any one of the configurations of in-registration, out-of-registration or in mixed-registration.

A plurality of routing members 70 are circumferentially spaced along an inner peripheral edge 72 of the plates and more preferably with equal spacing between adjacent members. The routing members project axially outwardly from the outer planar surface of the plate 46 and are generally cylindrical in shape and circular in cross-sectional dimension. The routing member can have a cross-sectional shape other than circular such as semi-circular, arcuate, polygonal, or other shape. A guide 74 extends from the routing member and is provided to act as a stop to prevent a linear element from moving axially and disengaging from the routing element 70. The guide 74 extends from an outer peripheral surface of the routing member 70 and radially inwardly spanning the intermediate ring 54 and terminating at a point above the inner ring of the plate 52 along a line drawn perpendicular to the outer planar surface 46. A routing member is associated with the three pluralities of contact points, and, preferably there is one routing member for each of two contact points in a single plurality of contact points. That is, it is preferable that the routing members are shared by the two pluralities of contact points. The routing members direct the linear members into engagement with a bottom portion of the contact points so that each section of the linear elements extending between the plates is of essentially the same length.

A boss 76 is centrally disposed on the inner ring of the plate 52 and extends axially away from the outer planar surface of the plate 46. The boss is a generally cylindrical wall defining a lumen 78 dimensioned to receive one of the axle's opposed ends and is in communication with a through hole of the plate. Two pairs of gussets 82 extend radially outwardly from the boss and form a generally V-shaped structure. Each gusset is generally triangular in shape with a hypotenuse extending axially downwardly from a top portion of the boss to the outer planar surface of the plate. Centrally disposed within the V is a through hole 84 dimensioned to receive the post 35 on the axle.

FIG. 1 shows one specific design or embodiment and a plurality of linear elements 20 with segments 90 extending between contact points on the plates such that there is one segment for each contact point on the first plate. Each segment forms an angle with the inner planar surface 48 from 15° to 75°.

Each contact point on the first plate, or first contact point, is connected to a second contact point on the second plate that is circumferentially spaced from the first contact point. The circumferential spacing can be quantified by a range of angles or by a range of contact point spaces. As for an angular spacing, in a preferred form of the invention, the first and second contact points will be circumferentially spaced about the axle from about 80° to about 175°, more preferably from 85° to 165° and most preferably from about 90° to about 155°. The spacing can be clockwise or counterclockwise about the axle provided that all linear elements are spaced in the same direction as shown in FIG. 1A. In embodiments such as that shown in FIG. 1B, where there are two pluralities of linear elements, one plurality of linear elements 20 is spaced clockwise while the second plurality 20' is spaced counterclockwise. However, where there are multiple pluralities of linear elements, each plurality of linear elements can be spaced in any combination of clockwise and counterclockwise directions.

In terms of a number of spaces expressed as a whole number, in an embodiment where there are n contact points disposed about 360° to form a circle and the contact points of the first plate are in circumferential registration with those on the second plate, then the number of the offset Y is within the range of Y=from 90° (n/360°) to about 155° (n/360°). Thus, for the embodiment shown in FIG. 1A, there are 28 contact points disposed in a circle and the number of offset Y will be from (28 contact points/360°)×90°=7 contact points to (28 contact) points/360°)×155°=12 contact points and more preferably from 8 to 11 contact points. Thus, if the contact point is one on the first plate then it will be from +7 to +12 or from 8 to 13 on the second plate.

The plurality of linear elements is a single, continuous piece of line, string, rope, fishing line, wire, 20 extending back and forth, in boustrophedonic-fashion, to connect all of the contact points of the first plurality of contact points 60 on the first plate to those of the first plurality on the second plate. With the circumferential offset between the contacting points, the linear elements 20 extend along a curvilinear path with adjacent linear elements not intersecting but being generally in parallel spaced relationship. That is, adjacent linear elements possess the same slope with respect to ring 50 yet do not intersect. This will be referred to as "generally" parallel spaced relationship. In another form of the invention, there could be any number of individual pieces of material including one for each pair of contact points, or n, or from 2 to n.

The linear elements will be guided by the lacing holes 66 and routing members 70 along the desired course to connect each of the plurality of lacing holes on the first plate to those on the second plate. For example, the linear element extends in a first direction from a location between the plates, through a lacing hole, then along the outer planar surface 46 of the plate, then about a routing member, and back through an adjacent lacing hole in a second direction opposite of the first direction. The segment of the linear element between the lacing holes and the routing guide will be referred to as a turning segment. In embodiments of the device with more than one plurality of contact points, say a first and second plurality of contact points or lacing holes, a first plurality of linear elements will be routed as described above through the first plurality of lacing holes and the second plurality of linear elements will be routed through the second plurality of lacing holes, and in a preferred form of the invention, the second plurality of linear elements will utilize the same routing members used for the first plurality of linear elements. Thus, the turning segments of the linear elements only contact the outer planar surface of the plate 46 and not the inner planar surface 48. Opposed ends of the pluralities of linear elements are secured by the O-rings 40 in the trough 38 at opposed ends of the axle to maintain the linear elements taut.

Sliding elements 22 can take on many forms but in a preferred form of the invention each includes a wall 104 defining a lumen 106 dimensioned to receive a linear element and slide thereon and rotate thereabout. (FIG. 8) In one form of the invention, the lumen will have openings to allow for threading of the linear element through the lumen. In another embodiment, the wall will be associated or attached to a piece or pieces that slidably engage the linear element like a bead. For example, a body can have a ring or rings attached thereto through which the linear element can be strung. Essentially, the ring or rings serve as the lumen. Suitable sliding elements include beads that can be of virtually any shape including cylindrical, spherical, hemispherical, polygonal, irregular, amorphous, letter-shaped, numeral-shaped, symbol-shaped, logo-shaped to name a few examples. In one form of the invention, the beads can be cube shaped with letters or numbers on each face of the cube and combinations can be used to form words, phrases and expressions. Each linear element can have the same type of bead or a different bead. The beads can be glow-in-the-dark, light reflective, translucent, transparent, opaque, light emitting, sound emitting and combinations of the same. The beads can be fabricated from any suitable material such as polymeric, metal, composite, mineral, naturally occurring material, stones, gems, and paper.

Figure 6:
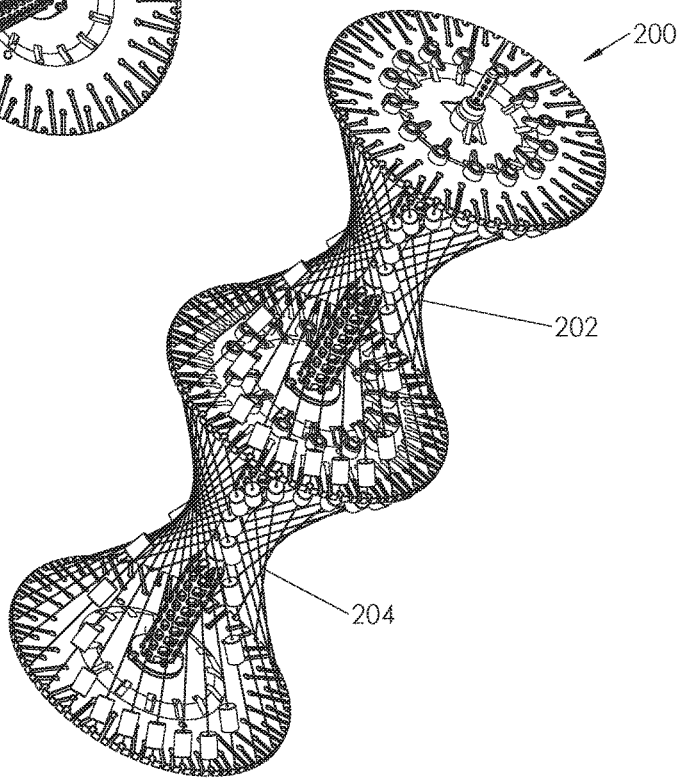
FIG. 6 is an isometric view of another embodiment of the present invention with two device units of FIG. 1 connected in series.

FIG. 6 shows another embodiment 200 of the present invention where there are three plates and each two plates has separate sets 202, 204 of pluralities of linear elements. It is contemplated that numerous devices 10 shown in FIG. 1 could be combined serially along multiple axles 12 that are disposed coaxially, or in parallel where the axles are vertically spaced in parallel spaced relationship. Thus, numerous individual devices units can be combined to make a multi-unit combined device.

Figure 7:
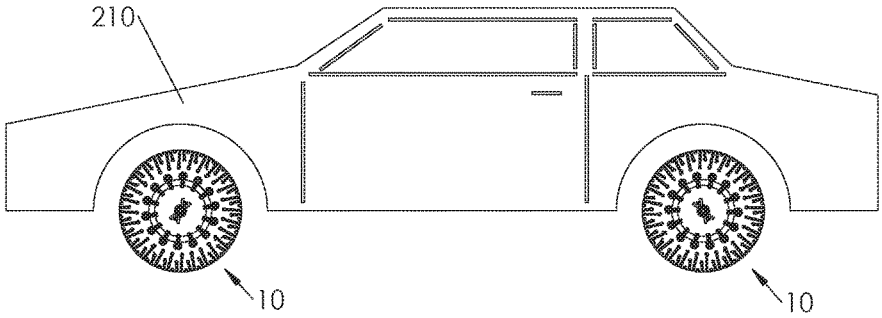
FIG. 7 is an isometric view of a derivative device where the device unit of FIG. 1 forms the wheels of a device car.
Figure 8:
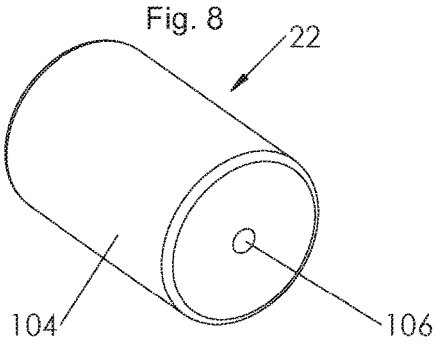
FIG. 8 is an isometric view of an exemplary sliding element.

FIG. 7 shows an embodiment of a derivative device where the device 10 forms the wheels of a ground engaging device such as a car 210, a truck, or other vehicle. It is also contemplated that the device can be mounted on a stand for use on a planar surface such a desktop or table top for art display purposes or amusement of visitors and the like. It is contemplated the device could be supported at both ends of the axle or on a single end with the opposed end extending in cantilever fashion. The axle can rotate within a bearing cup or a magnetic bearing for example. The device can be associated with a music producing element like a jewelry box where music is produced mechanically and in timing with the speed of rotation of the device, or with an electronic unit that produces music independently of the rotation of the device.

The device 10 can come in various sizes from the very small say an inch long, to very large, say 40 feet high and 60 feet long. It is contemplated that the device can be rotated by human power by hand, human power assisted by tools such as gears and levers, by motive power such as electrical power, wind power, solar power, water power, and an internal combustion engine.

Upon rotation of the device 10 about the axle 12, the sliding elements reach a point where the force of gravity is sufficient to cause the sliding element to leave its initial position in contact with the inner planar surface of one of the plates 52 and slide toward the opposed plate until it reaches the inner planar surface of the opposed plate. In the embodiment shown in FIG. 1, typically two sliding elements, one from each plate, will begin sliding in opposite directions from each of the plurality of linear elements. FIG. 6 shows two pluralities of linear elements so typically four sliding elements will initiate sliding at roughly the same moment with two in one direction and two in the opposite direction.

The material of the component parts of the device can be chosen to make a sound or sounds when the sliding elements contact the plates to add to the delight of the visual experience of playing with the device. The visual experience can be enhanced by using light reflecting or light emitting sliding elements. Additionally, light emitting elements can be mounted to the axle or the plates to illuminate the device and its component parts.

The plates and the axle can be formed from any material suitable for its purpose and includes polymers, metals, composites, paperboard, cork to name a few. Suitable polymers include polycarbonates, polyolefins, polyesters, polyamides, polyethers, polyetheramides, polystyrenes, polyacrylamides, polyacrylates, polyvinyl chloride, and polyethylene terephthalate to name a few. The polymers may be formed into the desired shapes by 3D printing, injection molding, thermoforming or other suitable polymer forming technique well known to those skilled in the art. Suitable metals include iron, aluminum, tin, lead, silver, gold, copper, platinum, palladium, molybdenum, osmium, and metal alloys such as steel, stainless steel, brass, pewter and the like. Most preferably, the plates and the axle are formed from a polycarbonate. The linear elements can be formed from string-like material including filament or filamentous material, thread, fiber, line, wire, cord, rope, twine, cable, chain, and hawser. The linear elements can have any color including decorative and eye catching colors.

The present invention also provides a kit or system for assembling the device. A kit would include the components necessary for assembling the device with instructions or access to instructions through the Internet to assemble the device from the components provided.

FIG. 9 shows a second form of the invention 300 that is externally supported by a cylindrical wall 302 and can be fully enclosed with end caps (now shown) placed over opposed ends 304. The opposed ends are generally circular surfaces or rings having circumferentially spaced contact points as described above. The linear elements 320 extend between the opposed ends 304 and attach to the contact points. The contact points can be lacing holes, hooks, glue or other means of attachment. The linear elements 320 will form the same curvilinear path and will have the same circumferential offsets and described above with respect to the embodiment of FIG. 1 and the sliding elements 322 can be the same as described above. The device 300 can be played with the same way as that of FIG. 1 by rotating the device about an axis of the cylindrical wall will cause the sliding elements to slide in reciprocating translational fashion between the opposed ends 304.

From the foregoing, it will be observed that numerous variations and modifications may be effected without departing from the spirit and scope of the invention. It is to be understood that no limitation with respect to the specific apparatus illustrated herein is intended or should be inferred.

It is, of course, intended to cover by the appended claims all such modifications as fall within the scope of the claims.

I claim:

1. A device comprising:

a first surface and a second surface supported in parallel spaced relationship for co-rotation about an axis of the device, the first surface having a first plurality of contact points from 1 to n that are circumferentially spaced from one another, the second surface having a second plurality of contact points from 1 to n that are circumferentially spaced from one another;

a plurality of linear components from 1 to n and one of each linear component extending along a curvilinear path between each of a first contact point on the first surface and a second contact point on the second surface circumferentially offset from the first contact point by about 95° to about 165°; and a sliding element mounted on one of each of the plurality of linear components for reciprocal translational motion between the first contact point and the second contact point upon rotation of the device about the axis of the device.

2. The device of claim 1 further comprising a member of supporting the first surface and the second surface comprising an axle or a wall.

3. The device of claim 2 wherein the first plurality of contact points are disposed in a generally circular pattern.

4. The device of claim 1 wherein each of the plurality of linear components are of essentially the same length.

5. The device of claim 1 wherein the plurality of linear components comprises a single continuous length of material.

6. The device of claim 1 wherein the plurality of linear components comprises more than one piece of material.

7. The device of claim 1 wherein each adjacent linear component of the plurality of linear components extend along a boustrophedonic course between the first surface and the second surface.

8. The device of claim 1 wherein each of the plurality of linear component is a string-like material.

9. The device of claim 1 wherein the first plurality of contact points and the second plurality of contact points are in circumferential registration.

10. The device of claim 1 wherein each contact point is a lacing hole.

11. The device of claim 1 wherein the sliding element comprises a body defining a lumen dimensioned to receive a portion of the linear component.

12. The device of claim 1 wherein the sliding element is a bead.

13. The device of claim 1 wherein the first contact point is circumferentially offset from the second contact point by about 85° to about 165°.

14. The device of claim 1 wherein the first contact point is circumferentially offset from the second contact point by about 90° to about 155°.

15. A device comprising:

an axle having opposed ends;

a first plate and a second plate connected to the axle and spaced from one another in parallel spaced relationship, the first plate having a first plurality of contact points from 1 to n that are circumferentially spaced from one another, the second plate having a second plurality of contact points from 1 to n that are circumferentially spaced from one another, with each contact point on the second plate circumferentially offset from each contact point of the first plate;

a plurality of linear components from 1 to n and one of each linear component extending between each of a first contact point X on the first plate with a second contact point on the second plate circumferentially offset from X by about 80° to about 175°; and a sliding element mounted on one of each of the plurality of linear components for reciprocal translational motion between the first contact point and the second contact point upon rotation of the device about the axle.

16. The device of claim 15 wherein each of the plurality of linear components are of essentially the same length.

17. The device of claim 15 wherein the plurality of linear components comprises a single continuous length of material.

18. The device of claim 15 wherein the plurality of linear components comprises from 2 to n separate lengths of material.

19. The device of claim 15 wherein the plurality of linear component comprises n separate pieces of material.

20. The device of claim 15 wherein the linear component extends along a boustrophedonic course between the first plate and the second plate.

21. The device of claim 15 wherein the linear component is a string-like material.

22. The device of claim 21 wherein the string-like material includes a filament, thread, fiber, line, wire, cord, rope, twine, cable, chain, and hawser.

23. The device of claim 15 wherein the first plate and the second plate have a shape selected from round, oval, polygonal, amorphous or in the form of letters of an alphabet, numbers, symbols, logos, trademarks, or combinations of the same.

24. The device of claim 23 wherein a portion of the contact points form a generally circular pattern concentrically disposed about the axle.

25. The device of claim 15 wherein each contact point is a lacing hole.

26. The device of claim 25 wherein a portion of each lacing hole is generally circular, semicircular, or polygonal.

27. The device of claim 25 wherein a portion of each lacing hole has a catch surface for directing a turning portion of the linear component along an outer planar surface of the first plate or the second plate.

28. The device of claim 27 wherein no turning portion contacts the inner planar surface of the first plate or the second plate.

29. The device of claim 25 wherein the first plate and the second plate each has an outer peripheral edge.

30. The device of claim 29 wherein each lacing hole is positioned on the outer peripheral edge.

31. The device of claim 29 wherein each lacing hole is positioned radially inwardly of the outer peripheral edge.

32. The device of claim 31 wherein each lacing hole is in communication with the outer peripheral edge.

33. The device of claim 32 further comprising a slot connecting each lacing hole to the outer peripheral edge.

34. The device of claim 25 further comprising a routing member associated with a pair of adjacent lacing holes.

35. The device of claim 34 wherein a portion of the routing member is generally arcuate.

36. The device of claim 34 wherein the routing member is generally circular in horizontal cross-sectional dimension.

37. The device of claim 34 wherein the routing member further comprises a guide to resist axially movement of the linear member.

38. The device of claim 15 wherein the sliding element comprises a body defining a lumen dimensioned to receive a portion of the sliding element.

39. The device of claim 15 wherein the sliding element is a bead.

40. The device of claim 15 wherein the first contact point is circumferentially offset from the second contact point by about 85° to about 165°.

41. The device of claim 15 wherein the first contact point is circumferentially offset from the second contact point by about 90° to about 155°.

* * * * *